US005720062A

United States Patent [19]

Vaught

[11] Patent Number: 5,720,062

[45] Date of Patent: Feb. 24, 1998

[54] COMBINATION LETTER SLITTER AND STAPLE REMOVER

[76] Inventor: Alan Vaught, 7422 Chapman Ave., Garden Grove, Calif. 92841

[21] Appl. No.: 801,777

[22] Filed: Feb. 14, 1997

[51] Int. Cl.[6] ..... B26B 11/00

[52] U.S. Cl. ..... 7/160; 30/123; 30/294; 30/DIG. 3

[58] Field of Search ..... 30/123, 294, DIG. 3; 7/160; 254/28

[56] References Cited

U.S. PATENT DOCUMENTS

| | | | |
|---|---|---|---|
| D. 352,217 | 11/1994 | Hochfieldetal . | |
| 2,567,021 | 9/1951 | Maynard | 254/28 |
| 4,069,585 | 1/1978 | Kuster . | |
| 4,670,926 | 6/1987 | Bruno | 7/160 |
| 5,282,316 | 2/1994 | Anderson . | |
| 5,285,577 | 2/1994 | Carney et al. . | |

*Primary Examiner*—Douglas D. Watts
*Attorney, Agent, or Firm*—James G. O'Neill

[57] ABSTRACT

A combination hand held device having an elongated central gripping portion with a razor type slitter held therein and a staple remover formed thereon. The letter slitter includes an elongated finger formed adjacent the razor type slitter along one side of the elongated central gripping portion and the staple remover is formed at one end of the elongated central gripping portion.

13 Claims, 1 Drawing Sheet

COMBINATION LETTER SLITTER AND STAPLE REMOVER

BACKGROUND OF THE INVENTION

1. Field of the Invention

This invention relates generally to office tools and more particularly to a combination letter slitter and staple remover.

2. Description of Related Art

Letter openers, particularly letter openers having a razor type slitter held therein have become increasingly more popular over the years for many reasons, including their ease in manufacture and use, and their small size. Also, because of the crowded desks of todays' busy executives and other workers, many objects used on and around desks have been made smaller and/or are designed to have more than one function or use.

One type of letter opener having more than one use is set forth in U.S. Pat. No. 5,285,577 to Carney et al., which discloses a letter opener having a razor type blade and a pocket or opening with a transparent cover for holding a business card. However, this letter opener cannot be used as a staple remover, and is limited to use as a letter opener and advertising specialty item.

A combined staple remover and letter opener is shown in U.S. Design Pat. No. 352,217 to Hochfield et al. However, this combined letter opener and staple remover appears to be made from metal and resembles a knife. That is, it has an elongated body with the letter portion formed as a knife edge or blade attached one end of a handle, with the staple remover secured to the other end of the handle. Such letter openers raise safety concerns because of the exposed blade or knife edge, and must be carefully handled and safely stored in a drawer or sheath, to prevent accidents.

While the foregoing described prior art devices have provided some limited improvements and overcome some of the problems encountered with the need for multiple uses and valuable space in a crowded work area, they are limited in application, present safety concerns, and are too expensive to manufacture. Therefore, after many attempts to solve the problems of devising an office device or tool which may be cheaply and easily manufactured for multiple uses in connection with safely opening letters and removing staples, in various settings and under different working conditions, there still exists the need for a simple, easy to store, transport and use, low-cost combination tool for slitting open letters and removing staples.

SUMMARY OF THE INVENTION

Accordingly, it is a general object of the present invention to provide an improved office tool. It is a particular object of the present invention to provide an improved combination letter slitter and staple remover. It is a still more particular object of the present invention to provide an improved combination letter slitter and staple remover which is both low in cost to manufacture and easy to use in all working conditions. It is yet a further particular object of the present invention to provide an improved combination letter slitter and staple remover made from lightweight plastic, having a razor type blade held therein, which offers added safety and ease in use and storage, in a minimum amount of space. And, it is a still further object of the present invention to provide an improved letter slitter made from lightweight plastic, having an integral staple remover formed thereon.

In accordance with one aspect of the present invention, there is provided a combination hand held device having an elongated central gripping portion having a razor type slitter held therein and a staple remover formed thereon, in which the letter slitter includes an elongated finger formed adjacent the razor type slitter along one side of the elongated central gripping portion and the staple remover is formed at one end of the elongated central gripping portion.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
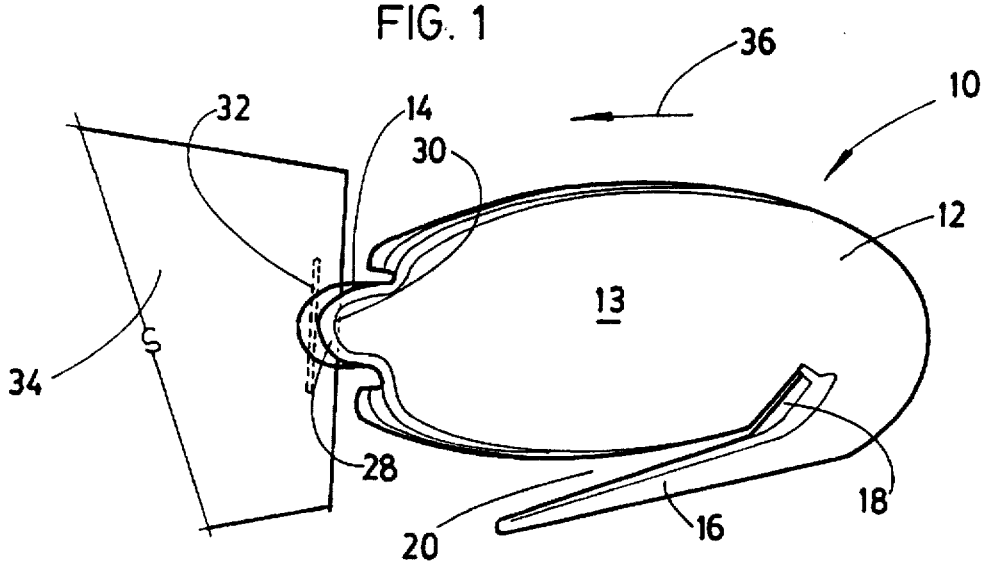
FIG. 1 is a top perspective view of one embodiment of a combination device of the present invention shown in position to be pushed so as to remove a staple from a plurality of sheets of paper partially shown therein.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for the general description of an improved hand held combination device or tool 10. The device 10 is preferably constructed by known fabrication techniques from a lightweight but high strength material so as to have a one piece or unitary body 12 comprising a central gripping portion 13, an integrally formed staple remover end 14, an integrally formed finger 16, and a razor type slitter blade 18 held therein.

Figure 2:
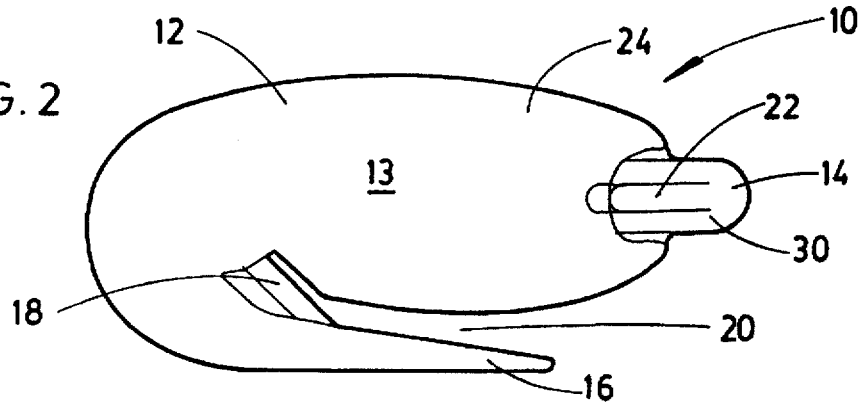
FIG. 2 is a bottom plan view of the combination tool of FIG. 1.
Figure 3:
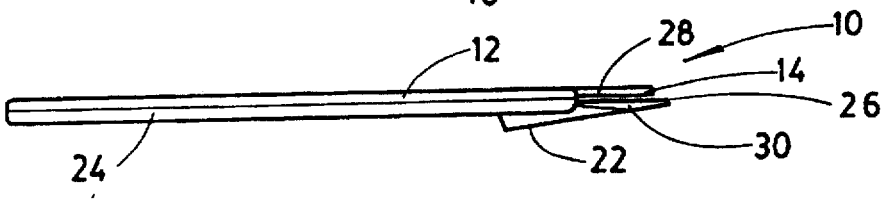
FIG. 3 a rear elevational view of the combination tool shown in FIG. 1.
Figure 4:
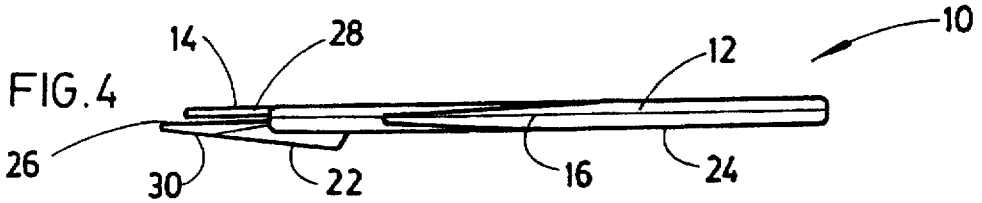
FIG. 4 a front elevational view of the combination tool shown in FIG. 1.
Figure 5:
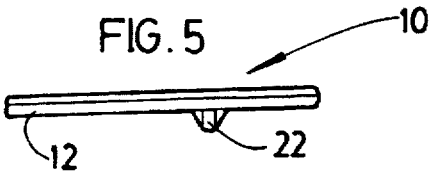
FIG. 5 a left end view of the combination tool shown in FIG. 1.
Figure 6:
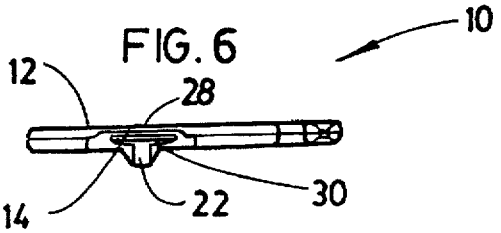
FIG. 6 a right end view of the combination tool shown in FIG. 1.

The device 10 may be made in any desired shape, from any available material, by any known fabrication method, but is preferably molded from plastic so as to be substantially flattened or thin in cross-section, when looking from the ends or sides, as shown in FIGS. 3–6, and substantially oval in shape, when looking from the bottom or top, as shown in FIGS. 1 and 2. The body 12, includes an elongated central gripping portion 13, having two ends and two side edges, with the staple remover 14 formed integrally therewith at one end, and the finger 16 formed integrally therewith at one side edge. An elongated opening or slit 20 is formed between the central gripping portion 13 and the integral finger 16, and the razor type blade 18 is securely held between the finger 16 and gripping portion 13 of the body 12 so as to be at the end of and facing the slit 20. The periphery of the oval shaped body 12 is preferably formed so as to be rounded and smooth to fit comfortably into the hand of a user.

The staple remover 14 includes an enlarged flange or ramp 22 integrally formed thereon extending onto a lower surface 24 of the body 12, and a space 26 formed between top and bottom finger-like portions 28, 30 thereof. In this manner, a user may firmly grip the gripping portion 13 of body 12 of the device 10 so as to be better able to push the device 10 (along the long axis of the device) to smoothly lift out or remove a staple 32, by the action of the ramp 22 and the bottom finger-like portion 30 pushed under the staple 32 holding together the partial sheets of paper or the like 34, as shown in FIG. 1. That is, the bottom finger-like portion 30 is first inserted into or under a staple such as 32 and the entire device 10 is then slid or pushed in the direction of the arrow 36, as shown in FIG. 1, to easily lift the staple 32 by the action of the moving ramp 22 and bottom finger-like portion 30. Staple so removed will be held in the space 26 between the finger-like portions 28 and 30.

The slitter portion comprising the finger 16 and razor type blade 18 is used to slit open an envelope or the like in a manner well known to those skilled in the art, as by inserting the finger 16 under the sealed flap of an envelope, gripping the central gripping portion 13 and moving the entire device 10 in the direction of the arrow 36 shown in FIG. 1, to cause the blade 18 to cut or slit the portion of the envelope flap it contacts to thereby open the envelope.

In use, the device 10 may be easily used to remove staples or slit open envelopes or the like, and is of a size that it will not take up much room on space on a desk top, in a desk draw, or hanging, as by the finger 16, from a suitable surface in or around a desk top. When needed, the device 10 is readily available and easily gripped in the hand of a user by the gripping portion 13, to selectively perform the necessary functions.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A hand held device comprising, in combination;

a body having an elongated central gripping portion; said body including a bottom surface, a top surface, two ends, and two side edges;

a staple remover formed integrally with said body at one of said two ends;

said staple remover including top and bottom finger-like portions, and a space formed between said top and bottom finger-like portions;

a finger portion formed integrally with said body at one of said two edges;

an elongated opening having an open end and a terminal end, formed in said body between said central gripping portion and the integral finger portion; and a razor-type blade securely held in said body between said finger portion and said gripping portion at said terminal end of said elongated opening.

2. The hand held device of claim 1 wherein said body is a substantially elongated flattened oval when looking toward said top surface.

3. The hand held device of claim 2 wherein the substantially elongated flattened oval body is molded from plastic.

4. The hand held device of claim 3 wherein said razor type blade is made from metal.

5. The hand held device of claim 4 wherein said bottom finger-like portion includes a ramp extending from said bottom surface of said body to a lower surface of said bottom finger-like portion.

6. The hand held device of claim 1 wherein said bottom finger-like portion includes a ramp extending from said bottom surface of said body to a lower surface of said bottom finger-like portion.

7. The hand held device of claim 6 wherein said elongated central gripping portion includes a periphery which is formed so as to be rounded and smooth to fit comfortably into a hand of a user.

8. The hand held device of claim 7 wherein said body is a substantially elongated flattened oval when looking toward said top surface.

9. The hand held device of claim 8 wherein the substantially elongated flattened oval body is molded from plastic.

10. The hand held device of claim 9 wherein said razor type blade is made from metal.

11. A hand held device comprising, in combination; a unitary body comprising a central gripping portion, an integrally formed staple remover, and an integrally formed elongated finger;

said unitary body also having a bottom surface, a top surface, two ends and two side edges;

said staple remover formed on said body at one of said two ends and comprising top and bottom finger-like portions, with a space formed between said top and bottom finger-like portions, and a ramp extending from said bottom surface of said body to a lower surface of the bottom finger-like portion;

said elongated finger formed on said unitary body at one of said two side edges;

an elongated opening having an open end and a terminal end formed in said unitary body between said central gripping portion and the integral elongated finger; and a razor type blade securely held in said unitary body between said integral elongated finger and said central gripping portion at a terminal end of said elongated opening.

12. The hand held device of claim 11 wherein said unitary body is a substantially elongated flattened oval when looking toward said top surface of said unitary body.

13. The hand held device of claim 12 wherein said substantially elongated flattened oval unitary body is molded from plastic and said razor type blade is made from metal.

* * * * *